United States Patent [19]

Yuhara

[11] Patent Number: 4,483,355

[45] Date of Patent: Nov. 20, 1984

[54] VANITY CASE

[75] Inventor: Yukitomo Yuhara, Abiko, Japan

[73] Assignee: Yoshida Industry Co., Ltd., Tokyo, Japan

[21] Appl. No.: 492,002

[22] Filed: May 5, 1983

[30] Foreign Application Priority Data

Oct. 25, 1982 [JP] Japan ..... 57-160273[U]
Nov. 9, 1982 [JP] Japan ..... 57-168639[U]

[51] Int. Cl.[3] ..... A45D 33/00
[52] U.S. Cl. ..... 132/83 R; 220/23.4
[58] Field of Search ..... 132/83 R, 99; 220/23.4

[56] References Cited

U.S. PATENT DOCUMENTS 1,875,541 9/1932 Zell ..... 132/83 R
3,586,010 6/1971 Landen ..... 132/83 R
4,276,893 7/1981 Enomoto ..... 132/83 R

*Primary Examiner*—Gregory E. McNeill
*Attorney, Agent, or Firm*—Wenderoth, Lind & Ponack

[57] ABSTRACT

A vanity case comprises a receptacle member, a cover member hinged with the receptacle member and urged to an open position relative to the receptacle, and a slide element disposed in a concave portion of the receptacle. The slide element has a nose and a first hook portion formed on the inner top end of the nose, the first hook being engageable with a second hook portion formed on the lower surface of the cover. The slide element also has a rear extension extending into a recess formed at the rear end of the receptacle, and when the rear extension is pushed forwardly the engagement between the first and second hooks is released by the forward movement of the first hook thereby opening the cover. A means for normally holding the slide element in the rearmost position is provided.

7 Claims, 6 Drawing Figures

VANITY CASE

BACKGROUND OF THE INVENTION

The present invention relates to improvement of a vanity case, and more particularly to improvement of a latch-unlatch mechanism for a vanity case in which a receptacle member is hinged with a cover member through a connection between a hinge block provided at the rear end of the cover member and a recess formed at the rear end of the receptacle member.

In the conventional vanity case of the type set forth above, the cover member is maintained in a closed position relative to the receptacle member by engagement between elastic latch tongues formed on the front edge of each member. These latch tongues should have a very high accuracy in dimension for obtaining a smooth engagement and disengagement therebetween. Otherwise, the cover member would open accidentally or a relatively strong force has to be exerted to open the cover, thereby causing trouble to a user. Therefore, when molding the vanity case, the utmost attention has been paid to the accuracy of the latch tongues. Nevertheless, quite a number of vanity cases have been rejected as defective owing to inferior engagement, and a low yield is one of the greatest problems of production.

In these circumstances, improved vanity cases have been proposed which are disclosed, for example, in the U.S. Pat. Nos. 4,276,893 and 4,331,168. Such vanity case is provided with a slide member in the vicinity of the latch tongue of either the case body or the cover member and, by pressing the slide member, the cover is forced to separate from the case body whereby the engagement between both latch tongues can be released. With this construction, some dimensional error can be allowed. However, this improvement is not free from defects, either. One of the defects is that since the slide member is designed to be inserted into a cavity slenderly extending in the longitudinal direction, shaking is likely to occur during a long use. Another defect is that since the latch tongues and slide member are arranged on the place which is externally accessible and therefore most exposed to eyes, designers encounter difficulties in representing various decorative designs on the vanity case. In addition, it is also considered to be unsatisfactory that the latch-unlatch mechanism still has to depend on elasticity of the projections.

Therefore, an object of the present invention is to provide a vanity case which is so simple in operation as to enable the user to open the cover member by one touch operation without a snap noise.

Another object of the present invention is to provide a vanity case in which engagement and disengagement between the protrusions do not require elasticity of the protrusions.

A further object of the present invention is the provision of a vanity case in which no shaky noise will occur thereby maintaining a high-grade image thereof.

A still further object of the present invention is to provide a vanity case which permits variety of design thereof without spoiling operability of the case.

SUMMARY OF THE INVENTION

A vanity case according to the present invention comprises a receptacle member having a concave portion for containing cosmetic material, a cover member to be hinged with the receptacle member, and a slide element disposed in the concave portion of the receptacle member. The receptacle member is formed at the rear end thereof with a recess into which a hinge block provided at the rear end of the cover member is fitted for pivotable connection, with the cover member being urged to an open position with respect to the receptacle member by any suitable means. The slide element has a nose and a rear extension, the nose upwardly extending from the front end of the slide element and being provided at its inner top end with a first hook portion, and the rear extension extending into the recess of the receptacle member without contacting the hinge block of the cover member. A second hook portion is provided on the lower surface of the cover member to be engaged with the first hook portion of the slide element, thereby maintaining the cover member in a closed position with respect to the receptacle member. The engagement between the first and second hook portions is released by a forward movement of the first hook portion when the slide element is pushed forwardly, whereby the cover member is opened by the urging means. Also, a means for holding the slide element in its rearmost position is provided.

Preferably, the means for urging the cover member to the open position comprises a pair of coil springs mounted on the upper surface of the receptacle member.

Further objects and features of the present invention will become apparent from the detailed description of preferred embodiments thereof when taken in conjunction with the accompanying drawings, in which:

DETAILED DESCRIPTION OF THE INVENTION

Figure 1:
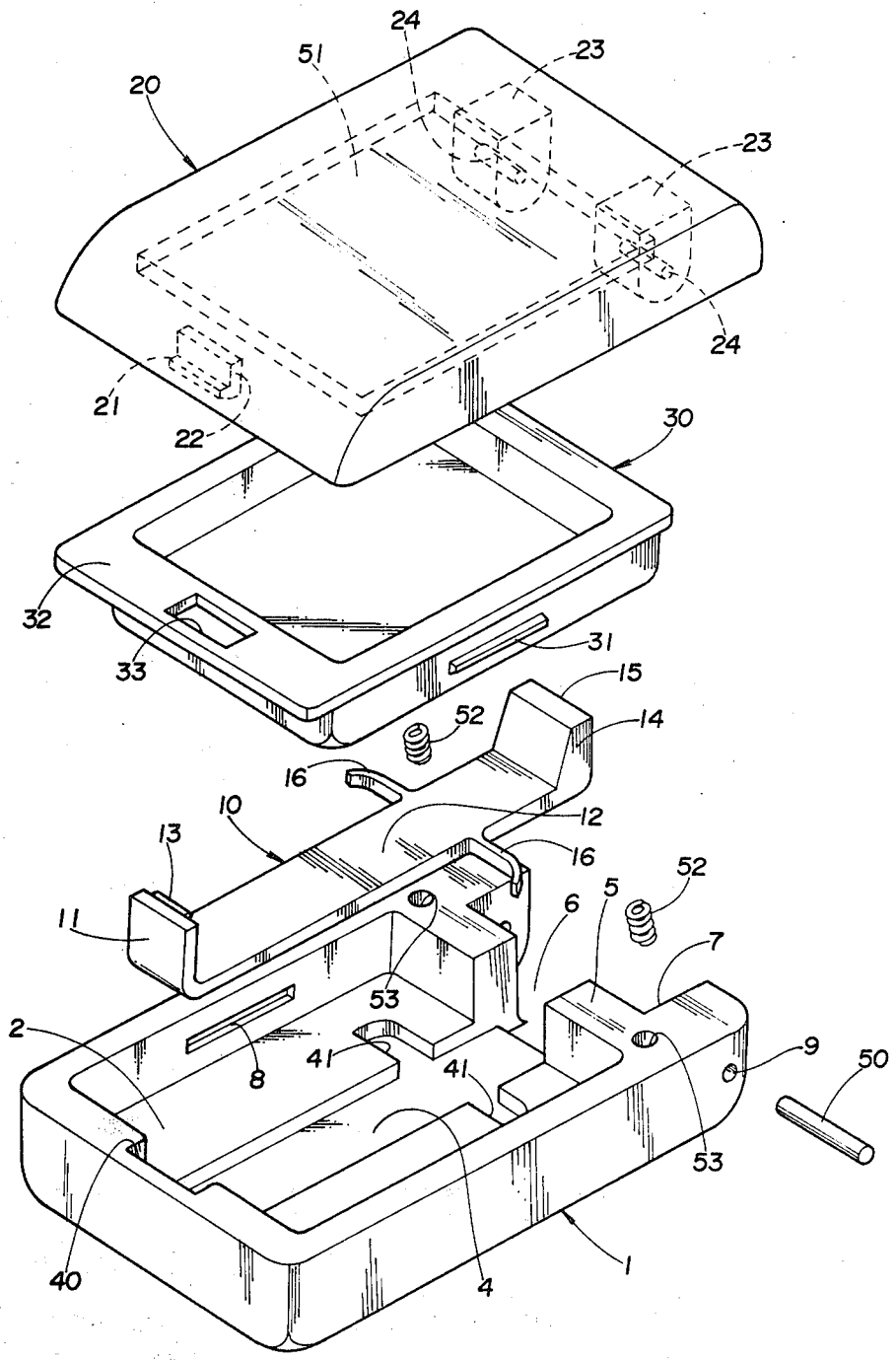
FIG. 1 is an exploded perspective view of a vanity case according to a first embodiment of the present invention, showing each part before assembly.
Figure 2:
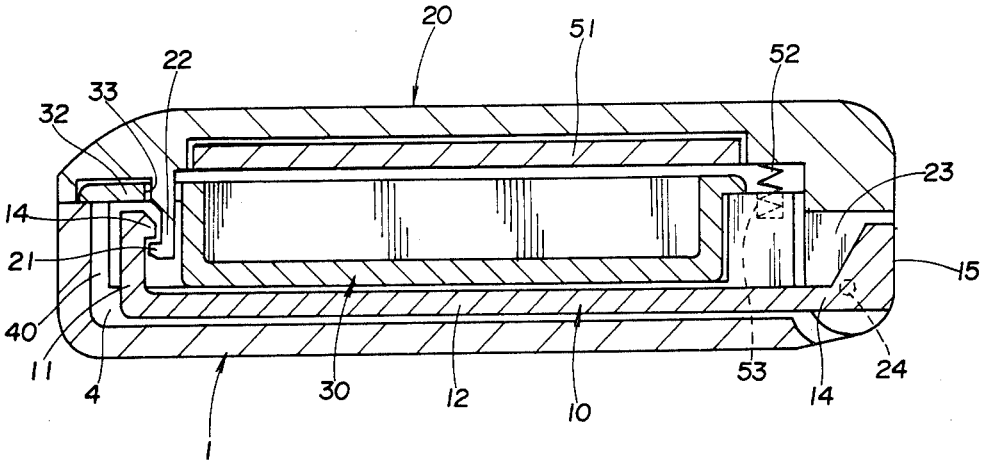
FIG. 2 is a sectional view of the vanity case shown in FIG. 1 in a closed position of a cover member after assembly.
Figure 3:
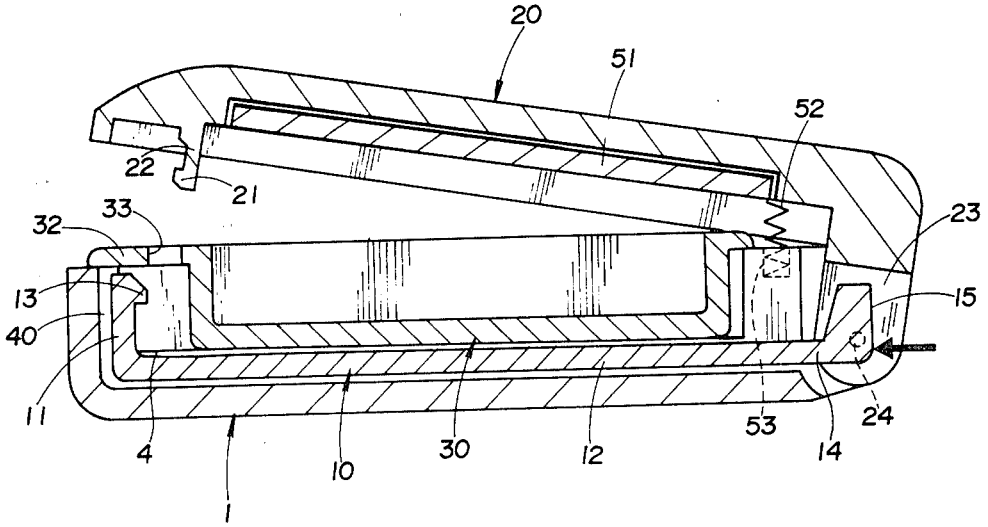
FIG. 3 is a similar sectional view of the vanity case, where a slide element is pushed forwardly and the cover member is opened.

Referring to FIGS. 1 to 3 of the drawing, there is shown a vanity case according to a first embodiment of the present invention. Reference numeral 1 indicates a receptacle member having a concaved portion 2 therein to receive a cosmetic containing tray 30. Provided on the bottom surface defining the portion 2 is a guide groove 4 which extends longitudinally from the front inner surface of the receptacle 1 to a rear end wall 5 defining the portion 2 and communicates, through a cut 6 formed in the rear wall 5, with a rectangular recess 7 which is provided at the rear end of the receptacle 1. The groove 4 also extends vertically on the front inner surface of the receptacle 1 to form a marginal space 40.

This guide groove 4 is intended to guide a longitudinal movement of a slide element 10 which is slidably fitted in the groove 4. The slide element 10 has at its front end a nose 11 extending upwardly from a base plate 12 of the element 10. Provided on the inner top end of the nose 11 is a first hook portion 13 adapted to be engaged with a second hook portion 21 formed on a cover member 20, as hereinafter described in detail. The slide element 10 also has at the rear end thereof an extension 14 extending through the cut 6 into the recess 7 where the extension 14 is enlarged to form a vertical end surface 15. This end surface 15 is, after assembly of the vanity case, accessible from the outside of the case so that the user may slide the slide element 10 by pushing the end surface 15 with her finger.

The slide element 10 may be provided with any suitable means elastically holding the element 10 in its rearmost position and, in this embodiment, the base plate 12 of the slide element 10 integrally connecting the nose 11 with the extension 14 is formed at the opposite sides with a pair of resilient pawls 16—16. The pawls are curved forwardly at the outer ends and are fitted in a transverse groove 41 extending at right angle to the guide groove 4. Thus, when the slide element 10 is pushed forwardly, the resilient pawls 16 generate a force tending to slide the element 10 rearwardly.

The cosmetic containing tray 30 is fixed to the receptacle member 1 by lateral protrusions 31 formed on the opposite side walls of the tray 3 and corresponding lateral slots 8 in the receptacle 1. The tray 30, upon being fixed in the concave portion 2 of the receptacle 1, prevents removal of the slide element 10 from the guide groove 4. Formed in a front flange 32 of the tray 30 is a hole 33 which permits entrance of a projection 22 of the cover member 20 into the concave portion 2 of the receptacle 1 to engage the second hook portion 21 with the first hook portion 13.

The cover member 20 is coupled with the receptacle member 1 so as to open and close relative to the latter. Particularly, the cover member 20 is provided on the lower surface of its rear end with a pair of downwardly extending hinge blocks 23—23 which are inserted in the recess 7 of the receptacle 1. After a pin hole 24 in each hinge block 23 is aligned with an eyelet 9 in the receptacle 1, a pivot pin 50 is pushed into the hole 24 and the eyelet 9 to pivotably connect the cover member 20 to the receptacle 1. The pair of hinge blocks 23—23 are disposed apart from each other thereby providing a space therebetween, where the extension 14 of the slide element 10 is located. Such arrangement permits a rotational movement of the hinge blocks 23 without being prevented by the extension 14, when the cover member 20 is opened or closed relative to the receptacle 1.

Attached on the lower surface of the cover 20 is a mirror 51 for convenience of the user. In front of the mirror 51 the projection 22 having the second hook portion 21 at the outer lower end thereof is formed and extends downwardly from the lower surface of the cover 20.

Further provided between the receptacle 1 and the cover member 20 is an urging means of any suitable type which urges the cover 20 to an open position relative to the receptacle 1. In this embodiment, such urging means comprises a pair of coil springs 52—52 mounted on the upper surface of the receptacle 1 at mounting holes 53—53.

FIG. 2 shows a closed position of the cover member 20 relative to the receptacle 1, where the first hook portion 13 is engaged with the second hook portion 21 to secure the cover 20 in the closed position against the spring force exerted by the coil springs 52 which are pressed by the cover 20. In this state, when the vertical end surface 15 is pushed forwardly by the finger of the user, the slide element 10 slides forwardly along the guide groove 4 to move the nose 11 in the same direction. Therefore, the first hook portion 13 on the nose 11 moves forwardly relative to the second hook portion 21 and the engagement between these hook portions is released without a click sound. Upon that movement, the cover member 20 is opened to a predetermined angle by the spring force of the coil springs 52, as shown in FIG. 3. The user may then open the cover 20 at any desired angle for using cosmetic material and the mirror 51.

The slide element 10 will return to the rearmost position shown in FIG. 2 due to the resiliency of the pawls 16 immediately after the pressure applied to the end surface 15 is removed. Assuming that the cover 20 is in the open position and the slide element 10 has returned to the rearmost position, when the cover member 20 is pressed downwardly, the second hook portion 21 will be smoothly engaged with the first hook portion 13 while sliding the element 10 forwardly and then rearwardly.

As will be understood from the description above, the cover member 20 can be opened quite easily and smoothly by pressing the rear end surface 15 of the slide element 10 forwardly. The engagement between the first and second hook portions 13 and 21 is released by the forward movement of the first hook portion. This means that no snap noise is generated and that the cover opening and closing operations no longer depend on "elasticity" of the hook portions. Furthermore, the hook portions 13 and 21 are provided inside the vanity case and therefore are not externally visible. The slide element 10 is also disposed inside the vanity case, and the only part that is externally accessible is the vertical end surface 15 located at the rear end which is apparently less exposed to eyes than the front end and/or the side portion. This structure will permit variety of the decorative design of the vanity case.

Figure 4:
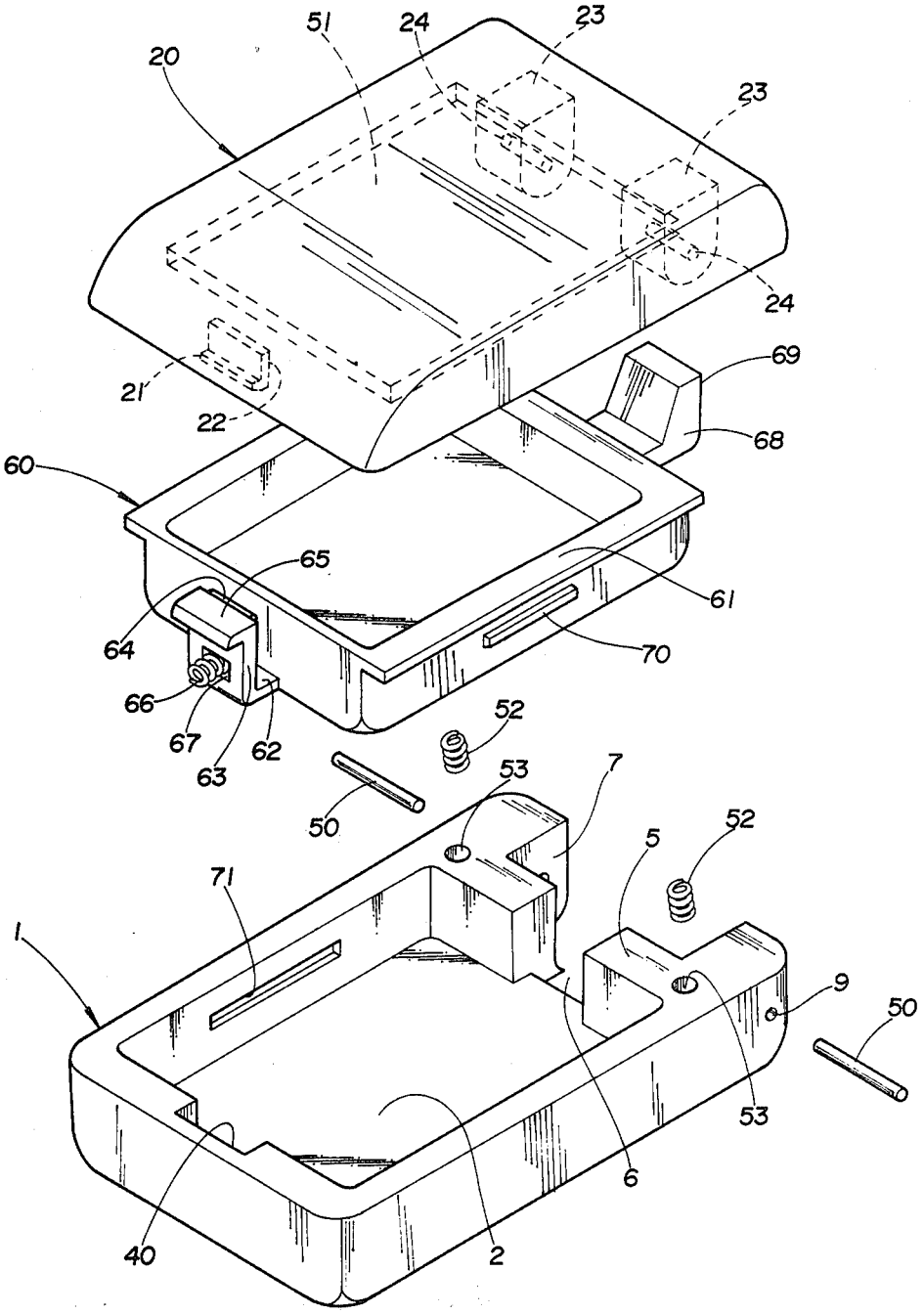
FIG. 4 is an exploded perspective view of a vanity case according to a second embodiment of the present invention.
Figure 5:
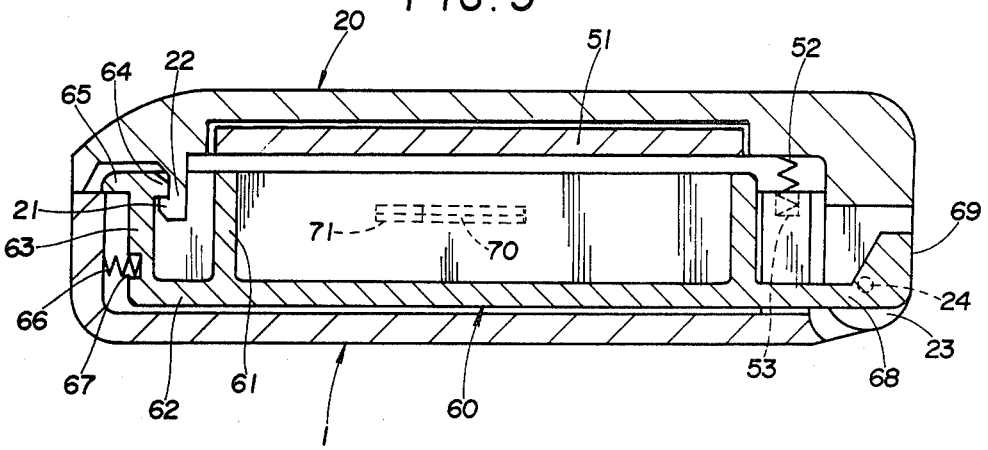
FIG. 5 is a sectional view showing the vanity case in FIG. 4 in a closed position of a cover member after assembly.
Figure 6:
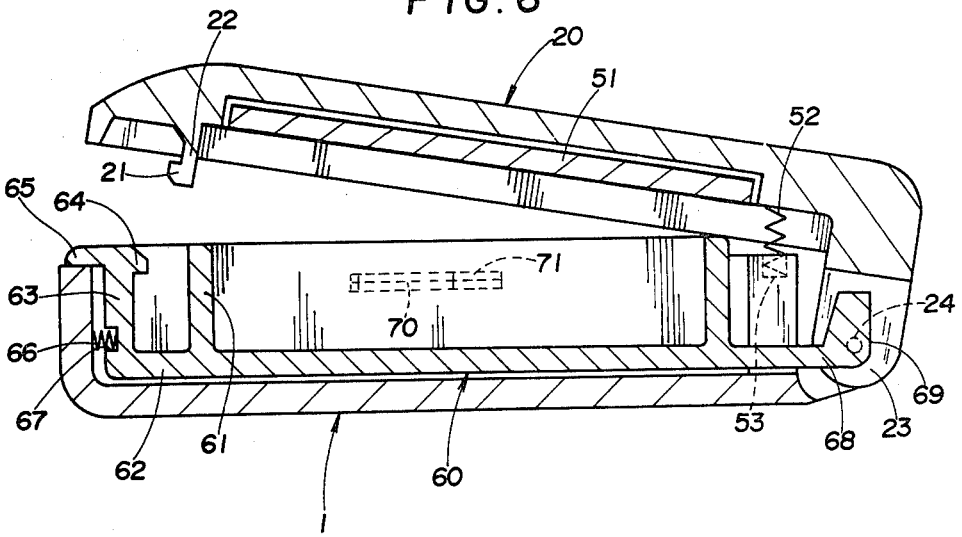
FIG. 6 is a sectional view of the same vanity case but in a position similar to FIG. 3.

Reference is now made to a second embodiment of the present invention, a vanity case according thereto being shown in FIGS. 4 to 6 in which the same parts are indicated by the same reference numerals. In this vanity case, a slide element generally indicated by a numeral 60 is integrally formed with a cosmetic containing tray 61. A front extension 62 is projected from the lower end of the front wall of the tray 61 to provide a space between the front wall and a nose 63 extending upwardly from the front end of the extension 62. The nose 63 has at the inner top end thereof a first hook portion 64 and at the outer top end thereof a flange 65 below which a spring 66 is fixed to the nose 63 at a mounting hole 67. The front end of the spring 66 is in contact with the front inner surface of the receptacle 1 at the marginal portion 40, thereby urging the slide element 60 rearwardly. The rear end of the slide element 60 extends beyond the rear wall of the tray 61 to form a rear extension 68 having enlarged portion which is located in the recess 7 of the receptacle 1 for convenience of pressing the slide element 60 at a vertical end surface 69.

The tray 61 is provided on both side walls with lateral protrusions 70 and the receptacle 1 has a pair of grooves 71 to receive the protrusions 70, thereby securing the tray 61 in the concaved portion 2 of the receptacle 1. The grooves 71 are formed longer than the protrusions 70 so that the latter may be slidable relative to the former, as particularly shown in FIGS. 5 and 6. Thus, when the slide element 60 is pushed forwardly, the tray 61 moves in the same direction with the element 60, whereby the first hook portion 64 thus moved forwardly is disengaged from the second hook portion 21 and the cover member 20 is opened to a predetermined angle by the spring force of the coil springs 52, as in the case of the first embodiment.

It will be seen that the grooves 71 guide the sliding movement of the tray 61, which permits omission of the guide groove 4 formed in the first embodiment. Also, the resilient pawls 16 provided in the first embodiment are omitted since the spring 66 mounted on the front end of the slide element 60 will hold the element 60 in its rearmost position.

Although the present invention has been described with reference to the preferred embodiments thereof, many modifications and alterations may be made within the spirit of the present invention.

What is claimed is:

1. A vanity case comprising:

a receptacle member having a concave portion for containing cosmetic material therein and having a recess at a rear end thereof;

a cover member having a hinge block at a rear end thereof;

said receptacle member and said cover member being hinged together by fitting said hinge block into said recess;

a means for urging said cover member to an open position with respect to said receptacle member;

a slide element slidably disposed in said concave portion, said slide element having a nose and a rear extension, said nose extending upwardly from the front end of said slide element and being provided at the inner top end thereof with a first hook portion, and said rear extension extending into said recess without contacting said hinge block;

a second hook portion formed on the lower surface of said cover member;

said cover member being maintained in a closed position with respect to said receptacle member by an engagement between said first and second hook portions, said engagement being released by a forward movement of said first hook portion when said slide element is pushed forwardly, whereby said cover member is opened by said means for urging said cover member; and a means for holding said slide element in the rearmost position.

2. A vanity case according to claim 1, wherein said slide element includes a base plate extending longitudinally to integrally connect said nose with said rear extension, said base plate being slidably fitted in a guide groove formed in the bottom surface defining said concave portion, said guide groove being communicated with said recess through a cut formed in the rear wall of said receptacle member, and said slide element is prevented from removal by a cosmetic containing tray secured in said concave portion over said slide element.

3. A vanity case according to claim 2, wherein said means for holding said slide element in the rearmost position comprises a pair of resilient pawls each laterally projecting from a respective side of said base plate, and said pawls are fitted in a transverse groove formed in said bottom surface across said guide groove.

4. A vanity case as claimed in claim 1, wherein said slide element includes a cosmetic containing tray, said nose is located apart from the front wall of said tray, said rear extension extends beyond the rear wall of said tray, and said tray is slidably secured in said concave portion.

5. A vanity case according to claim 4, wherein said tray is provided on both side walls thereof with lateral protrusions, and the inner side surface of said receptacle member defining said concave portion is formed with lateral grooves to be engaged with said protrusions, said grooves being longer than said protrusions, thereby permitting sliding movement of said tray with said slide element.

6. A vanity case as claimed in claim 4, wherein said means for holding said slide element in the rearmost position comprises a spring mounted on the front surface of said nose, the outer end of said spring being in contact with the front wall of said receptacle member.

7. A vanity case according to claim 1, wherein said means for urging said cover member to said open position comprises a pair of coil springs mounted on the upper surface of said receptacle member, the upper ends of said coil springs being in pressure contact with the lower surface of said cover member when said cover member is in said closed position.

* * * * *